United States Patent [19]

Hitchcock

[11] 4,122,569

[45] Oct. 31, 1978

[54] INTEGRATED UNIVERSAL TOOL

[76] Inventor: Thomas H. Hitchcock, Box 8644, San Marino, Calif. 91108

[21] Appl. No.: 690,799

[22] Filed: May 27, 1976

[51] Int. Cl.[2] ..... B25F 1/04

[52] U.S. Cl. ..... 7/134; 7/142; 7/168

[58] Field of Search ..... 7/7, 3 R, 7.1, 16, 3 A, 7/4, 5, 1 G, 5.4, 5.6, 6; 30/161, 154, 122, 143, 144, 146, 152, 155, 29; 81/177 UJ

[56] References Cited

U.S. PATENT DOCUMENTS

| | | | |
|---|---|---|---|
| 2,168,405 | 8/1939 | Haas | 7/16 |
| 2,662,568 | 12/1953 | Lavietes | 7/16 |
| 3,370,307 | 2/1968 | Beeks | 7/7 |

FOREIGN PATENT DOCUMENTS

| | | | |
|---|---|---|---|
| 106,956 | 3/1943 | Sweden | 7/1 B |
| 27,426 | 1/1903 | Switzerland | 30/161 |
| 9,237 of | 1896 | United Kingdom | 7/16 |
| 605,522 | 7/1948 | United Kingdom | 7/7 |

*Primary Examiner*—James L. Jones, Jr.
*Assistant Examiner*—Roscoe V. Parker
*Attorney, Agent, or Firm*—Norman L. Chalfin

[57] ABSTRACT

The integrated universal tool is a novel combination tool which provides these functions: A locking knife blade, a locking saw blade, a locking Phillips bladed screwdriver, a locking small flat bladed screw driver, a locking large flat bladed screwdriver, a crescent wrench, graduated calipers for measuring inside and outside dimensions, left and right-handed shears, a nibbler, a wire stripper, and an electrical terminal crimping tool. This combination of tools is allowed by the use of the integrated universal. The universal is a universal joint located at the end opposite the crescent wrench. The blades of the tool are fastened to this universal joint and can be rotated into the extended or retracted positions about its two axes. This allows three extended blade positions and one closed position. The integration is the integrating slide.

5 Claims, 4 Drawing Figures

INTEGRATED UNIVERSAL TOOL

SUMMARY

Object of the Invention (Basis)

The object of the invention is to provide a combination tool providing more strength and more functions than any tool described in prior art or manufactured. The essence of the invention which allows this is comprised of the following elements: a frame consisting of two rails open at one end and joined at the other, an operating element articulated at the end of and between the rails and rotatable 360° about an axis between the rails, one or more additional operating elements sidewardly and rotatably mounted with respect to the previous operating element via an axis passing thru the previous axis at its centermost point and perpendicular to it, these additional operating elements being capable of 360° of rotation in this axis, or rotation simultaneously with the centermost operating element in the other axis, a sliding housing which conforms to the cross section of all the operating elements and the rails at the point adjacent to the universal axes. Said sliding housing locking any or all operating elements either extended or retracted with respect to the rails, said sliding housing being slidably moveable to the opposite end of the rails allowing unhindered rotation of any or all of the blades.

Object of the Invention (Criteria)

The object of the invention is to provide the optimum tool. In order to make this claim, the tool has to satisfy all criteria for what makes a good tool in all ways better than any predecessor. Most important to a tool is its integrity. Is it strong enough to do its work? Work is the transmission of energy from the users hand to the material being manipulated. Strength of a tool is controlled by three factors: quality of material, quality of manufacture and quality of design. Design is the most important factor that is changeable relative to strength in toolmaking. Good design should allow for normal wear, and provide means whereby sharpening and take-up of play can be made with relative ease. The design should balance input and output forces, so that with normal usage, the force applied by the user will not distort or break any of the tool parts. The tool parts should be individually replaceable so that if the strength of the tool is exceeded, only the damaged parts need be replaced. The parts of the tool should be designed to be made by the most simple and inexpensive methods available, thus allowing a greater portion of the tool's cost to be applied towards quality of materials and manufacture.

The other primary objective of a tool is universality, or without sacrificing its strength, how many jobs can it do? Just numbers are not enough, it must do all its work conveniently, with ease of operation similar to non-combinational tools. This means excess or unused material must be at an absolute minimum. The tools must also represent the most commonly needed tools in any randomly occurring situation requiring tools of a given class. The tools should be easily interchangeable, with one hand if possible. Universality in essence means that a tool should be able to do anything in its field. These criteria are what the integrated universal tool addresses itself to; the following description should make clear how this is accomplished.

Object of the Invention (Attributes)

It is the object of this invention to provide a novel combination tool which provides the following features: a crescent wrench, graduated caliper for inside and outside measurement, a locking small flat bladed screwdriver, a locking large flat bladed screwdriver, a locking Phillips bladed screwdriver, a locking knife blade, a locking saw blade, a right handed shear, a left handed shear, a nibbler, a wire stripper and an electrical terminal crimper. The tool essentially resembles a conventional crescent wrench with an enlarged handle. The means which allows all these tools to be related together is described as the integrated universal. This means that the various blades are mounted on a universal joint opposite the wrench end of the tool. The universal allows any and all of the blades to be extended or retracted. The integration refers to the slide. It forms an exoskeletal band around the joint when it is in the locked position. This positively locks any desired tool in the extended position, or locks the tool in the retracted position. When the slide is unlocked, it allows the tool blades to rotate freely about their various axes; either for a change of mode or when the various plying functions are used (e.g., shears and crimpers). Thus, the universal joint allows any tool function to be included into one compact shape, and the integrating slide combines great rigidity and strength with ease of interchangeability; i.e., any tool function can be extended and locked or unlocked and retracted with only one hand.

It is the further object of the invention that the principle of universal integration not be limited to any particular selection of tools. The integrated universal can be applied to tool combinations pertaining to any trade, craft, or profession, providing that the tool parts can be made to conform to the proper shape. It is the object of the invention to provide the tools in standardized sizes and to offer interchangeable tool blades of various types. It is a further object of the invention that the principle of universal integration allows more blades to be added in either axis. That is, whereas the tools as depicted have three and five blades in the screw axis, one or more blades can be stacked in this axis or the other thus providing the possibility of even more functions being provided. It is an object of this invention that the proportions of the various parts of the tools as drawn have been selected to provide a balance of input and output force. This balance allows maximum utility without either causing excessive wear, or breakage because of unduly applied force.

PRIOR ART (Existing compound tools)

The prior art which this invention intends to supercede with respect to function falls essentially into three categories: folding blade tools, removable bit tools and sliding blade tools. The folding blade combination tool is probably best exemplified by the Swiss army knife. These types of tools are limited by two factors. First, the blades cannot be locked positively enough to utilize both sides of the blades. Conventional locking mechanisms are complicated and costly. Secondly and most significantly, these tools are inherently weak at the junction of the blade and the handle, thus restricting the force capable of being transmitted relative to the mass of the tool.

Removable bit type tools can best be described as multiple bladed screwdrivers, wherein more than one blade can be interchanged in a collet. These tools can provide more strength but are more restricted in the variety of their uses. They are also subject to the possibility of loss of the tool bit.

Sliding bladed tools such as U.S. Pat. No. 3,370,307 are ones wherein the tool blades are contained within the handle and slidably extended when used. These tools are bulky and generally complicated and as such have never seen much use.

None of the above three types of tools provide shearing, wire stripping or terminal crimping functions. The integrated universal tool does all three, similarly to crimping pliers.

PRIOR ART (Tools exhibiting mechanical similarities to present invention)

A search of prior art has disclosed two tools which best exemplify the prior art with respect to universal integration as a means of articulation and locking. One utilizes a universal method of articulation, while the other uses a sliding type of keeper to allow selection and locking of tools. The universal tool is essentially a single-bladed knife consisting of three major parts and two pins. The major parts are: a knife blade, a two-rail frame which is bent into a U-shape somewhat similar to the universal integrated frame, and a flat metal piece also bent into a U-shape. The knife blade rotates with respect to the frame similarly to the centermost blade of the integrated universal tool. The flat U-shaped member is articulated similarly to the sideward blades of the integrated universal tool, this flat U-shaped metal provides both a means for locking and concealing the blade in the closed position. This tool uses the universal means of articulation, yet does not exploit potential of more than one blade, nor allow for a sliding type of lock mechanism.

The second tool, U.S. Pat. No. 2,662,568 dated July 15, 1949, uses a sliding keeper and has multiple blades, but only has articulation about a single axis. This tool is essentially a multiple bladed screwdriver with four blades. The tool consists of a cylindrical tube which comprises the housing, and a handle firmly fastened to one end of the tube. Four blades are rotably mounted on a U-shaped frame which can slide inside the tube, in a manner similar to the universal integrated tool except that the blades are stacked between the rails. A pin, fastened to the frame and extending thru a slot in the housing, allows the frame and blades to be slidably moved away from the handle, thus allowing the blades to be rotated so that a particular blade is rotated into the extended position, after which the frame and blades are slid back within the housing, thus locking the desired blade into position. This tool uses a locking method somewhat similar to the universal integrated tool, but does not employ the universal joint nor allow maximum utilization of space or diversity of function that the universal integrated tool provides.

DESCRIPTION OF THE DRAWINGS

FIG. I is a front view of the universal integrated tool of this invention showing a plurality of tools opened out on the axes thereof.

FIG. II is a side view of the fully closed tool, showing the tool elements nested in their storage position.

Figure 1:
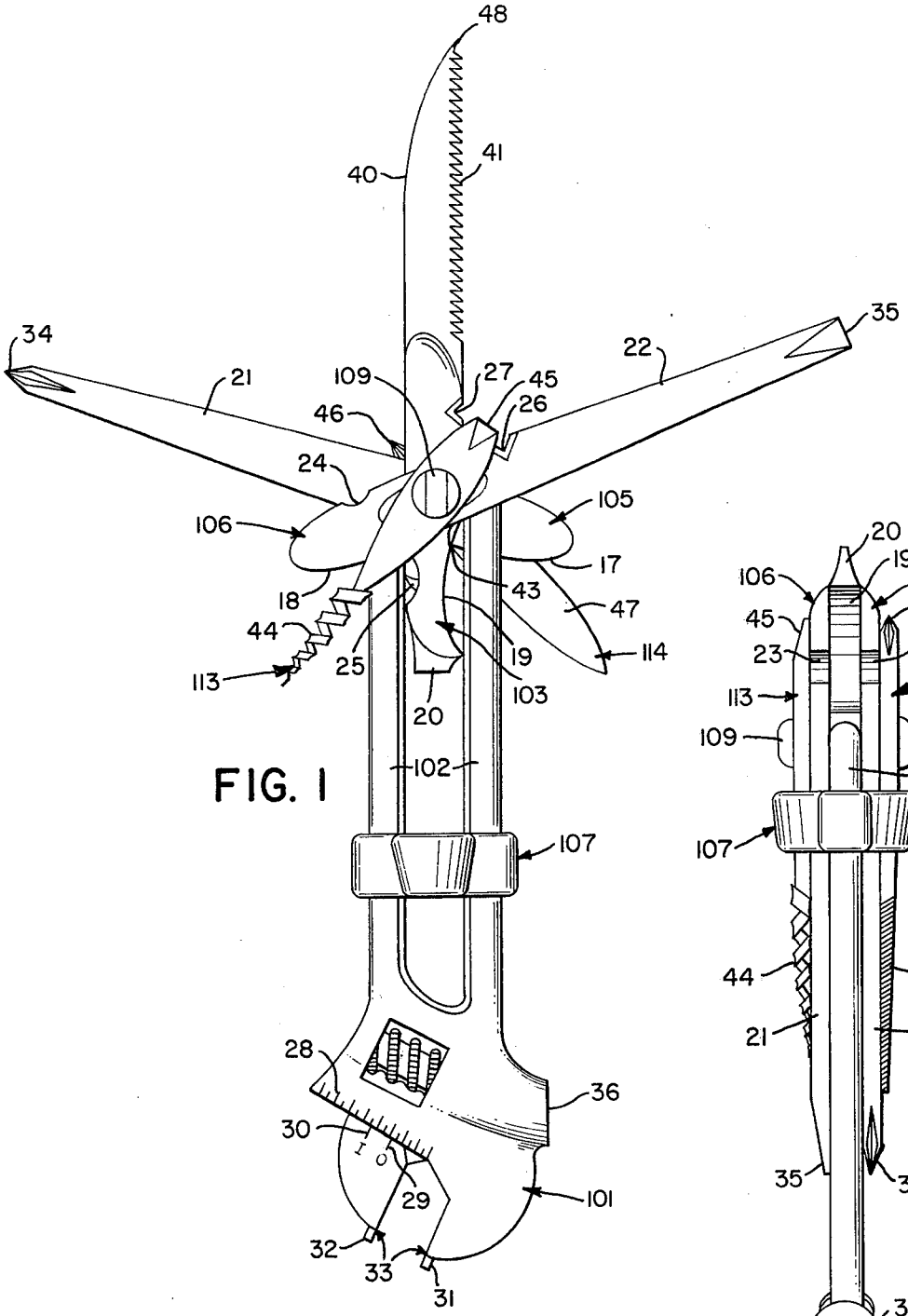
Figure 2:
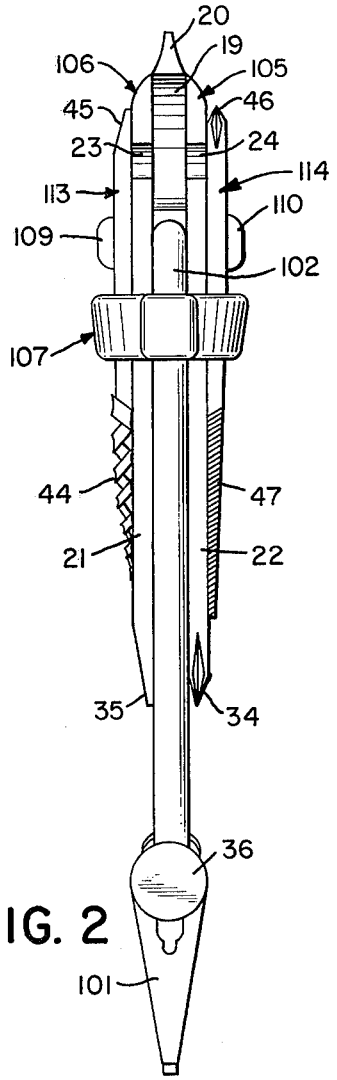
Figure 3:
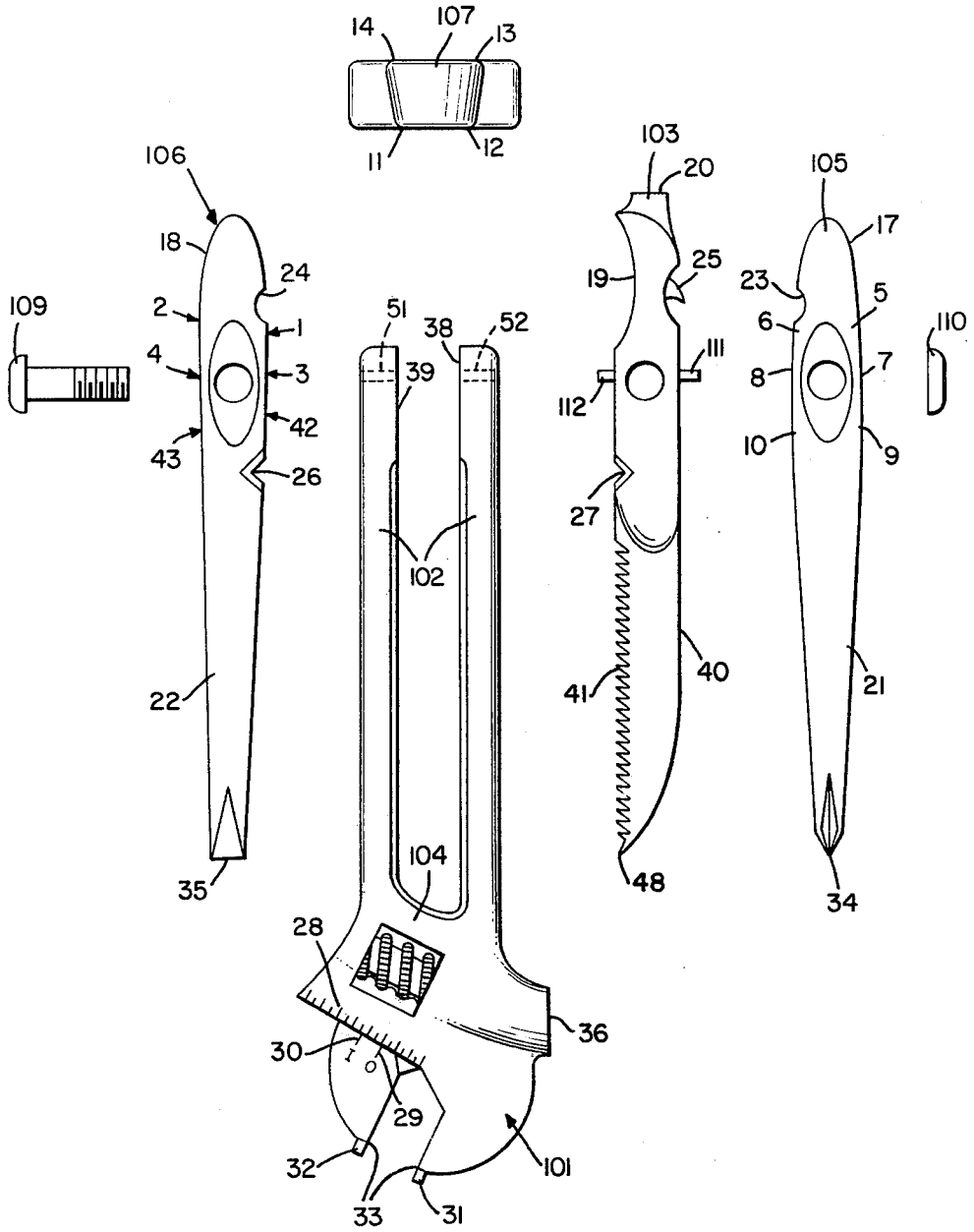
Figure 4:
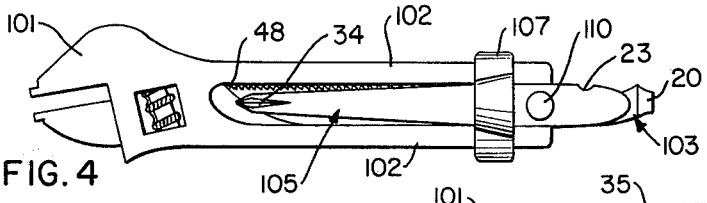
Figure 5:
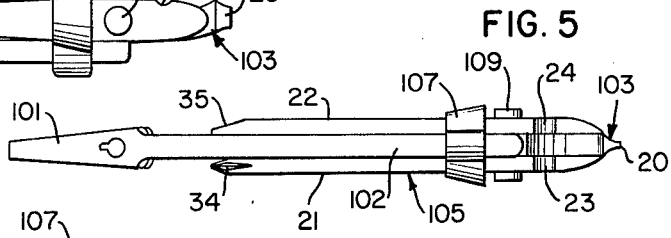
Figure 6:
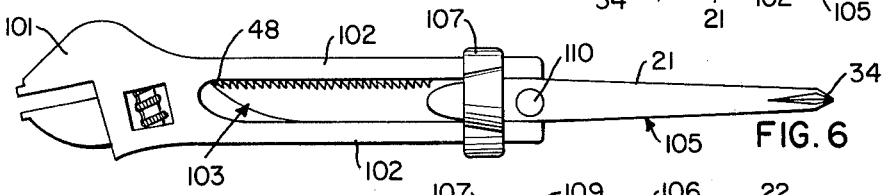
Figure 7:
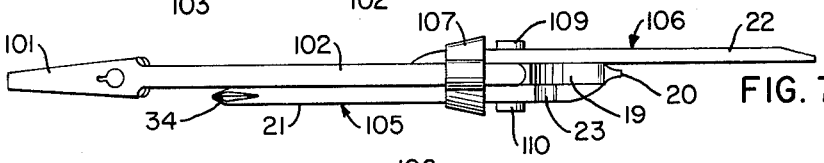
Figure 8:
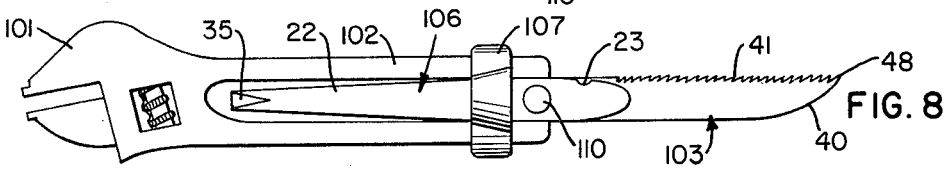
Figure 9:
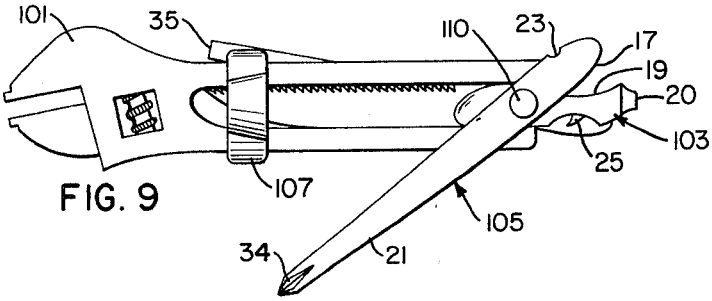
Figure 13:
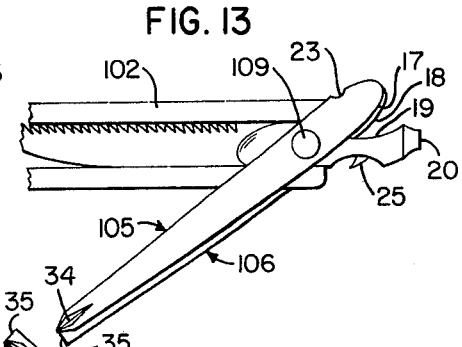
Figure 10:
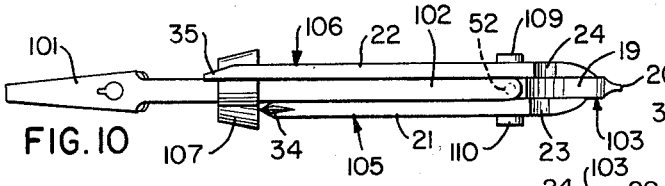
Figure 11:
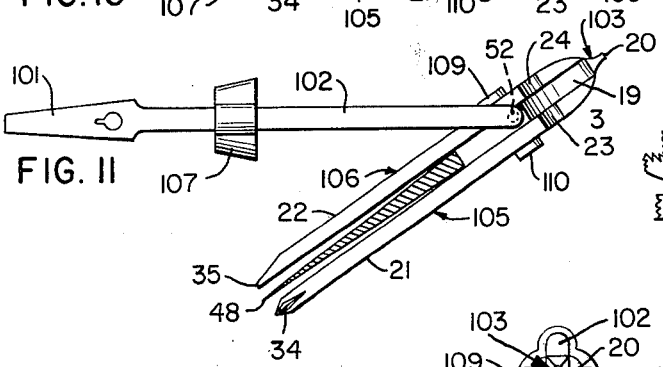
Figure 14:
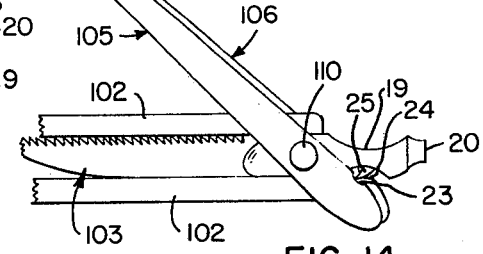
Figure 12:
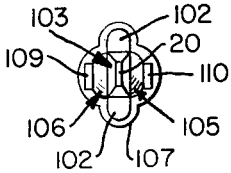

FIG. III is a disassembled view showing a side view of all the parts.

FIG. IV is a front view with the tool closed and the slide locked.

FIG. V is a side view opposite to that shown in FIG. II with the tool closed and the slide locked.

FIG. VI is a front view of the tool with the Phillips blade extended and the slide locked.

FIG. VII is a side view of the tool similar to FIG. V with the flat blade screwdriver to element extended and the slide locked.

FIG. VIII is a front view of the tool similar to FIG. VI with the knife-saw blade extended and the slide locked.

FIG. IX is a front view of the tool with the right hand shear being actuated and with the slide unlocked.

FIG. X is a side view rotated 90° with respect to FIG. IX with the right hand shear being actuated and with the slide unlocked.

FIG. XI is a side view of the tool showing the stack of tool elements in rotation about the pin axis with the slide unlocked.

FIG. XII is an end view of the tool in its closed position with the slide locked.

FIG. XIII is a partial view of the articulation end of the tool with slight perspective showing the nibbling function and with the slide unlocked.

FIG. XIV is a partial view of the tool similar to FIG. XIII with slight perspective showing the crimping function and the slide unlocked.

SPECIFICATION (DESCRIPTION OF COMPONENTS)

The integrated universal tool comprises the following principal parts: Referring to FIG. III: a frame 102, a central blade 103, sideward blades 105 and 106, the integrating slide 107, the screw 109, and the locknut 110.

The frame consists of a pair of parallel rails 102, interconnected at one end 104 and open at the other 38, 39. The interconnected end is terminated by a crescent wrench of conventional design 101. The rails 102 extend rearwardly from the jaws of the wrench. The rails are essentially cylindrical throughout their length 102, with flattened bosses at the rearwardmost points with the flattened surfaces facing each other 38 and 39. Holes 51, 52 are drilled in both rails at the rearmost end. These holes are in the same axis and accommodate the pins 111 and 112 of the centermost blade 103. This blade also has a large hole 15 drilled perpendicular to and intercepting the axis of the pins 111 and 112. The width of the blade as viewed from the side exactly corresponds to the width between the flattened bosses 38 and 39. The length of the blade 103 on the end between the pins and the tip 48 is incrementally less than the distance between the pinholes 51, 52 of the rails and the interconnection of the rails, thus allowing 360° of rotation of this blade 103 or with respect to the frame. See 48 in FIGS. IV and XI. This blade 103 is incrementally wider than the rails 102, at the top 103. See FIGS. II and V.

One end of the blade comprises a combination knife 40 and saw blade 41. Between the combination part of the blade 40, 41 and the pins 111, 112 is a notch 27, which corresponds to a notch 26 on the sideward blade 106 and is used as a wire stripper. On the shorter end of the centermost blade 103 is a pin 25 used for the crimping function in combination with the two sideward blades 105, 106, at 23 and 24, and a curved recess 19 in blade 103 which forms one half of the shear with either sideward blade 105, 106 at 17 and 18 or the centermost blade 103 of the nibbler if both sideward blades 105, 106 are used simultaneously. The tip of this end of 103 provides a flat bladed screwdriver 20.

The sideward blade 106 has a hole 16 by which it is articulated to the centermost blade 103. The tip of its longer half is a flat bladed screwdriver 35. There is also a notch 26 which corresponds to notch 27 of the center blade 103. These two elements form the wire stripper. The area 18 comprises one half of a shear blade with respect to the center blade 103, 19. The notch 24 comprises a portion of the electrical terminal crimper in juxtaposition with parts 23 of tool element 105 and 25 of tool element 103. This blade 106 is essentially flat with respect to the side which is adjacent to the centermost blade 103.

Blade 105 is essentially similar to blade 106 with the exceptions: it does not have a wire stripping notch 26, it possesses a Phillips screwdriver bit 34 instead of a flat bladed bit 35; and it has threads inside hole 37 to accommodate the screw 109. In all other respects it forms an exact mirror image of blade 106.

The integrating slide is essentially a convoluted collar which forms around the cross sections of all the blades and the rails at a point adjacent to the universal joint. (See FIG. II).

The two sideward tool elements 112, 114 appearing in FIGS. I and II and not in subsequent figures can be described as an auger-corkscrew combination 113, the longer part of the blade being a flattened helix 44 and the shorter being a small flat bladed screwdriver 45. This blade has an elongated hole by which it is articulated. The other sideward tool element 114 is a small file 47 with a small Phillips head screwdriver 46 at the opposite end. Tool elements 113 and 114 articulate with screw 109 held in place by nut 110. Tool elements 113 and 114 engage screw 109 and nut 110 respectively. Screw 109 provides an axle for rotation of tool elements 103, 105, 106, along with elements 113 and 114. The screw-axle 109 together with pins 111 and 112 in rails 102 (see FIG. III) form a universal joint. The tool assembly of elements 103, 105, 106, 113 and 114 when aligned as in FIG. II all rotate on the axis provided by pins 111, 112 inserted in rails 102 to nest between the faces 38 and 39 in rails 102.

SPECIFICATION (DESCRIPTION OF FUNCTIONS)

The integrated universal tool is a compound hand tool based on the principle which the inventor describes as the integrated universal. This is a novel method of incorporating a number of common hand tools into one unit. The principle of universality can be understood as a universal joint which joins the blades to the handle of the tool. The pin axis 111 and 112 joins the centermost knife blade 103 to the wrench handle or rails 102 at 51, 52. The other articulated axis on screw 109 joins the tool elements together in the screw axis 109. The third axis drawn thru the tip of wrench jaw 31 and the center of the pin 111, 112 and screw axis 15, will be called the work axis 109, because the whole tool is rotated about this axis when the screwdriver functions are used. (FIGS. IV thru VII). All three axes cross the center of the knife blade 103 at one point, and are perpendicular to each other at 15. The universal joint allows all three blades to rotate about the pin axis simultaneously thru 360° of rotation, FIG. XI. The screw joint 109 allows the two screwdriver blades 105 and 106 to be rotated about the screw axis 109 360°, either simultaneously or independently of each other (FIGS. I, IX, XIII and XIV). Thus the universal allows the extension of either of the side blades by 180° of rotation thru the screw axis, FIGS. VI and VII. The extension of the knife, FIG. VIII, is accomplished from a closed position, by rotating all three tool elements 103, 105, 106 180° about the pin axis 51, 52, FIG. XI, then returning the two side blades to the closed position by rotation of 180° about the screw axis 109. This can be accomplished by reversing these two steps also. Thus the universal principle allows the extension of the individual tool elements, and a fully closed position, which exposes the large screw driver blade 20.

The principle of integration occurs as the sliding keeper 107 locks the tool elements 103, 105, 106, 113 and 114 in place. This keeper moves slidably along the rails 102. It is stopped at both ends of its motion. At the wrench head end 101 it is stopped just clear of the tool element tip 34, 35, 48. This allows the blades to rotate about their various axes unhindered. When moved to the universal end it forms a tight band surrounding all the blades and prevents their movement. (FIGS. II, IV, V, VI, VII and VIII). The integrating slide or keeper 107 is essentially a band which conforms exactly to the cross section of the tool at the point adjacent to the universal joint when in the locked position. The keeper 107 thus allows the tool elements 103, 105, 106, 113, 114 to be easily released and locked. The keeper 107 integrates the universal joint structurally so as to allow large amounts of force to be transmitted thru the tool without deformation of the joint or movement of an extended tool element.

In addition to the functions using the locked blades, the design also allows shear (FIGS. IX and X) crimping (FIG. XIV) and wire stripping functions. These are accomplished with the slide released. The shear functions occur between the central knife blade 103 at 19 and either or both side blades 105 and 106 at 17 and 18 respectively. With the tool completely closed and the slide released, the shears can be actuated by rotating either of the slide tool elements 105, 106 90° (FIGS. IX and X). The shear jaws are located at the ends of the blades now outside the universal joint 17, 18 and 19. The input handles for these functions are the bit ends of the two screwdrivers 21 and 22 rotating relative to the tool body. Moving both blades 105, 106 simultaneously accomplishes the nibbling function (FIG. VIII). Moving both blades 105, 106 180° from the nibbling function brings the crimping jaws together, 23, 24 and 25. (FIG. XIV). The wire strippers are a combination of the knife blade 103 at 27 and the sideward blade 106 at 26 inside the universal joint. The tool element 106 is rotated in the screw axis thus allowing the V-notches in the two tool elements 103, 106 to form the wire stripping tool.

The remainder of the tool consists of a crescent wrench 101 with a conventional method of moving the jaw. The crescent wrench also incorporates the function of graduated calipers. The increments are located on the cheek of the wrench at 28. The indicators 30, 31 are on the movable jaw. "I", 30 indicates the distance between the jaws internal surfaces 33. The "O", 29, indicates the dimension between the bosses 31 and 32 on the tips of the jaws for external measurements.

The flat screwdriver tool element 106 and Phillips screwdriver tool element 105 are locked into position by the slide 107. This locking is made positive by means of a taper incorporated in the shanks of these blades and a corresponding shape in the slide. The maximum width of the flat blade 106 is the distance between 3 and 4. The dimensions 1 to 2, and 42 to 43 being slightly less than 3 to 4, and equal to each other. The dimension 7 to 8 of the Phillips blade 105 is equal to the dimension 3 to 4. The dimension 5 to 6, 9 to 10, 1 to 2, and 42 to 43 are all equal. The slide 107 will be tapered with dimension 13 to 14 being slightly larger than 12 to 11. Dimensions 13 to 14 of the slide would correspond to 3 to 4 and 7 to 8 of the blades, while dimension 11 to 12 would correspond to dimension 1 to 2 et al of the blades. It will be noted that the location of maximum width 3 to 4 and 7 to 8 is not exactly aligned with the axis of the pivot screw 109. This offset serves the purpose of causing the taper of an extended blade to encounter the slide in advance of the closed blade. This is done to insure that the extended blade is always most positively locked, and also can compensate for any wear of the mating parts.

A flat boss has been incorporated on the head of the crescent wrench 36 to be used for hammering. When this function is used the sideward blades 105, 106, 113, 114 can all be extended and the slide locked to provide a longer radius of arc when pounding.

I claim:

1. A composite hand tool comprising: a frame, open at one end and closed at the opposite end thereof; said frame comprising a pair of rails extending between said open and said closed end;

a first tool element forming a part of said closed end of said frame;

a first axle means mounted in and bridging said open end of said frame;

a second tool element pivotally mounted on said first axle means and being positionable thereon for storage nesting between said rails;

a second axle disposed in said second tool element and perpendicular to the axis of said first axle, said second axle forming a universal joint with said first axle;

a plurality of additional tool elements mounted on said second axle, each of said plurality of additional tool elements being individually articulatable on said second axle selectively to a use position and a storage position; and;

a keeper slidably disposed about said frame and being positionable thereon for holding any of said plurality of tool elements rigid and in an adjacent and parallel position relative to said frame when said tool elements are in said storage position and holding any extended tool elements in place in the use positions thereof, said keeper being slidably movable to another position on said frame whereby said second tool element is rotatable freely on said first axis and said plurality of additional tool elements may be rotated about said second axle unhindered.

2. The tool of claim 1 wherein the second tool element contains a combinational blade having saw teeth on the back edge of a conventional knife blade, said knife and saw being fully sheathed when this end of the element is between the rails, the second tool element being completely constrained from any motion when the blade is extended or retracted, and the retainer is brought to its extreme position adjacent to the axles.

3. The tool of claim 1 wherein the second tool element and the adjacent elements are so formed that they perform shearing or crimping operations with respect to each other.

4. The tool of claim 1 wherein said first tool element is an adjustable wrench having graduations marked on it which indicate the size of the jaw opening, for either external or internal measurements and having a flattened boss adjacent to the fixed jaw suitable for hammering, and said second and additional tool elements include screw driver elements, a saw blade, a knife blade, shears, a nibbler, a wire stripper, an electrical terminal crimping tool, an auger and a file.

5. The tool of claim 1 wherein said keeper is tapered internally in areas corresponding to the location of said additional tool elements, said additional tool elements being tapered externally to correspond to the internal taper of said keeper and to interfit therewith when said keeper engages said tool elements in the use or storage positions of said tool elements.

* * * * *